US008420206B2

(12) United States Patent
Bernegger et al.

(10) Patent No.: US 8,420,206 B2
(45) Date of Patent: Apr. 16, 2013

(54) CAMOUFLAGE PATTERN AND METHOD OF MAKING SAME

(75) Inventors: Paul Bernegger, Greenville, WI (US); Kurt Windus, Greenville, WI (US)

(73) Assignee: Outdoor Identities, LLC, Greenville, WI (US)

( * ) Notice: Subject to any disclaimer, the term of this patent is extended or adjusted under 35 U.S.C. 154(b) by 251 days.

(21) Appl. No.: 12/500,983

(22) Filed: Jul. 10, 2009

(65) Prior Publication Data

US 2011/0008591 A1 Jan. 13, 2011

(51) Int. Cl.

| | |
|---|---|
| ***B41M 5/00*** | (2006.01) |
| ***B44C 1/17*** | (2006.01) |
| ***G03G 7/00*** | (2006.01) |
| ***B32B 3/00*** | (2006.01) |
| ***G06K 9/00*** | (2006.01) |

(52) U.S. Cl.
USPC ..... 428/195.1; 428/919; 428/196; 382/162

(58) Field of Classification Search ..... 428/919
See application file for complete search history.

(56) References Cited

U.S. PATENT DOCUMENTS

| | | | | |
|---|---|---|---|---|
| D143,347 | S | 12/1945 | Park | |
| D184,337 | S | 2/1959 | Bunday | |
| 4,494,245 | A | 1/1985 | Burkhead et al. | |
| 4,576,904 | A | 3/1986 | Anitole | |
| 5,677,017 | A | 10/1997 | Freeman | |
| 5,727,253 | A | 3/1998 | Wilkinson | |
| 5,753,323 | A | 5/1998 | Andrus | |
| D401,072 | S | 11/1998 | Loverin | |
| 5,924,131 | A | 7/1999 | Wilkinson | |
| 6,017,079 | A | 1/2000 | Warner | |
| 6,342,290 | B1 * | 1/2002 | Conk | 428/195.1 |
| 6,524,419 | B1 * | 2/2003 | Dabrowski et al. | 156/230 |
| D484,706 | S | 1/2004 | Hodges | |
| 6,682,879 | B2 | 1/2004 | Conk | |
| 6,811,835 | B1 | 11/2004 | Parietti | |
| 6,859,983 | B2 | 3/2005 | Curtis et al. | |
| 6,912,440 | B2 | 6/2005 | Tooley | |
| D538,050 | S | 3/2007 | Tardif | |
| D538,543 | S | 3/2007 | Bloomer | |
| D557,902 | S | 12/2007 | Parrish | |
| D572,909 | S | 7/2008 | Crye et al. | |
| 7,512,326 | B1 | 3/2009 | Eldredge et al. | |
| D592,861 | S | 5/2009 | Crye et al. | |
| D626,751 | S | 11/2010 | Bernegger et al. | |
| D630,023 | S | 1/2011 | Bernegger et al. | |
| D632,494 | S | 2/2011 | Bernegger et al. | |

(Continued)

FOREIGN PATENT DOCUMENTS

| | | |
|---|---|---|
| WO | 2011/037670 | 3/2011 |

OTHER PUBLICATIONS

International Search Report and Written Opinion for Application No. PCT/US2010/41535 dated Mar. 4, 2011 (8 pages).

(Continued)

*Primary Examiner* — Mark Ruthkosky
*Assistant Examiner* — Laura C Dettinger
(74) *Attorney, Agent, or Firm* — Michael Best & Friedrich LLP

(57) ABSTRACT

A camouflage pattern or system which includes a simulated natural underwater environment or habitat having fish species therein is provided.

19 Claims, 5 Drawing Sheets
(5 of 5 Drawing Sheet(s) Filed in Color)

U.S. PATENT DOCUMENTS

| | | | |
|---|---|---|---|
| D632,495 | S | 2/2011 | Bernegger et al. |
| 2002/0110652 | A1 | 8/2002 | Conk |
| 2004/0202846 | A1 | 10/2004 | Conk |
| 2005/0005339 | A1 | 1/2005 | Johnson |
| 2007/0212957 | A1 | 9/2007 | Halliday |
| 2008/0095990 | A1 | 4/2008 | Boone et al. |
| 2009/0017269 | A1 | 1/2009 | Johnson |
| 2009/0154777 | A1 | 6/2009 | Cincotti et al. |

OTHER PUBLICATIONS

International Preliminary Report on Patentability for Application No. PCT/US2010/41535 dated Aug. 9, 2011 (5 pages).

United States Patent Office Action for U.S. Appl. No. 29/339,961 dated Apr. 1, 2010 (7 pages).

United States Patent Office Action for U.S. Appl. No. 29/339,954 dated Apr. 1, 2010 (7 pages).

United States Patent Office Action for U.S. Appl. No. 29/339,959 dated Apr. 1, 2010 (6 pages).

United States Patent Office Action for U.S. Appl. No. 29/339,956 dated Apr. 1, 2010 (6 pages).

* cited by examiner

CAMOUFLAGE PATTERN AND METHOD OF MAKING SAME

A variety of patterns have been used to camouflage people and objects in an outdoor environment to prevent detection by other people and animals. Military personnel use camouflage patterns on clothing, vehicles and other military equipment for combat and training. Other users of camouflage include hunters, bird watchers, paint ball players and other outdoor enthusiasts. A good camouflage can disguise hunters and other wildlife watchers to avoid startling wildlife.

In recent years, many people have been drawn to articles with camouflage or camouflage-like patterns, such as camouflage patterned clothing. "Camo clothing" includes, for example, wedding dresses and tuxedos as well as other articles for a full "camo" wedding. Obviously, such use of camouflage patterns is not meant for concealment or disguise but rather as a fashion statement, and, possibly, to signal association of the wearer or wearer's family to military experiences or to hunting and other outdoor activities.

Camouflage patterns typically employ splotches of brown or green in different shades over a contrasting background, and have taken the form of a repeated pattern of a particular hue or shade, in an attempt to simulate colors of the natural environment. More recent camouflage patterns are composed of repeating geometric shapes with borders, including pixilation shapes and images. Such camouflage typically has two or three colors, including green, brown, or black. A pattern of intermingled light and dark shades of green with some shades of brown mixed in has been used for hiding a person in a forested environment. Light brown camouflage with dark borders around geometric shapes has been used to match a dry, desert background.

Realistic camouflages have also become popular. For example, realistic artistic renderings of natural patterns, such as drawings of tree bark, have also been used as camouflage patterns. However, the process of designing and rendering the patterns by hand is subjective, inaccurate, time consuming, and requires a designer with a high level of artistic skill as well as an understanding of the principles of camouflage design.

Use of photographic images is another technique that has been used to create camouflage patterns. One technique generally involves taking a photograph of the environmental background where the camouflage pattern is intended to be used, and then processing the photograph to yield a somewhat random, high contrast pattern. The resulting pattern does not realistically resemble any object photographed, rather the resulting high contrast pattern lacks detail (e.g., a plurality of disruptive patterns), and instead resembles the abstract appearance of traditional camouflage patterns.

Camouflage clothing manufacturers have also attempted to create a more realistic appearance by using, e.g., plant-like three-dimensional additions or artistic renderings or photographic images of wilderness scenes or objects. Unfortunately, camouflage clothing with three-dimensional additions is noisy, cumbersome and snags.

BRIEF DESCRIPTION

A camouflage pattern or system is provided in accordance with embodiments of the invention. The pattern or system includes a composite image of a simulated three-dimensional natural underwater environment having fish species therein. The images include a background, foreground and midground. The background and foreground depict environmental elements which include rocks, water grasses, water plants, branches, logs, leaves, sands, corals and combinations thereof. The midground includes one or more fish native to the environment. The foreground overlays the midground to partially conceal the fish, i.e., environmental elements of the foreground partially conceal the fish. The colorations in the images are natural colors of the fish, the environment and light reflected in the water. Although the pattern or system gives the appearance of a camouflage, use of the pattern or system need not be necessarily for concealment or disguise purposes. For example, the pattern or system may be used as an identifier of those who enjoy fishing or fish and associated objects, e.g., boats.

In one aspect, the system in accordance with embodiments of the invention provides an article of manufacture and a pattern. The article suitably includes a surface having the pattern of repeating images in accordance with embodiments of the invention incorporated therein or applied thereon. The article is suitably, for example, clothing, a vehicle, fabric, or outdoor equipment.

In another aspect, the camouflage material includes a repeating pattern simulating a natural realistic-appearing, three-dimensional underwater habitat of a fish species. Specifically, the material includes a background and foreground of natural underwater environmental elements and a midground pattern with fish species, including one or more fish, overlaying the background. The environmental elements include water grasses, rocks, branches, water plants, logs, leaves, sands, corals and combinations thereof. The background and foreground colorations include any shade of blue-green, green or yellow, from light green to dark green, to blue green, from yellow to yellow-green. The fish sometimes overlap with or touch the environmental elements tangentially, and have a variety of different markings including striations, speckles or splotches. The fish assume any number of different arrangements or positions in relation to the environmental elements. Thus, the material is configured with embodiments of the pattern in accordance with the invention to mimic the fish in its natural three-dimensional underwater environment.

Embodiments of the inventions also provide methods of making a camouflage pattern and camouflage material, including transfer of the pattern to a substrate.

Other advantages and a better appreciation of the specific adaptations, variations, and physical attributes of the invention will be gained upon an examination of the following detailed description of the invention, taken in conjunction with the accompanying drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The invention may be better understood and appreciated by reference to the detailed description of specific embodiments presented herein in conjunction with the accompanying drawings of which.

DETAILED DESCRIPTION

Figure 1:
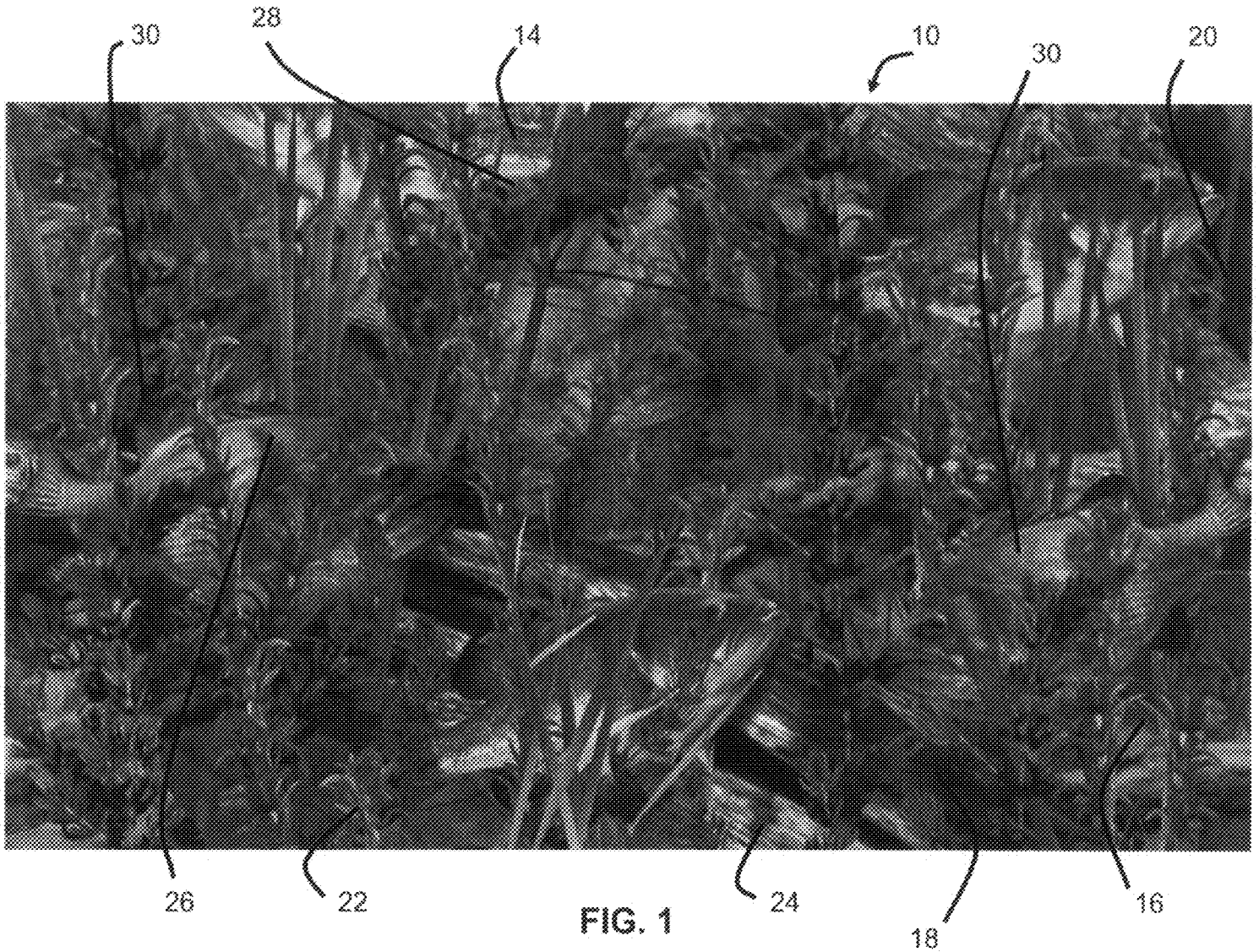
FIG. 1 is a front view of an exemplary embodiment of a pattern in accordance with the invention.

A camouflage pattern or system embodying the principles illustrated in embodiments of the invention is provided. The pattern or system includes a simulated natural underwater environment or habitat having fish therein.

Before any embodiments of the invention are explained in detail, it is to be understood that the invention is not limited in its application to the details of the structure and function set forth in the following description or illustrated in the appended drawings. The invention is capable of other embodiments and of being practiced or of being carried out in various ways.

Also, it is to be understood that the phraseology and terminology used herein is for the purpose of description and should not be regarded as limiting. The use of "comprising," "including," or "having" and variations thereof herein is meant to encompass the items listed thereafter and equivalents thereof as well as additional items. "Comprising" also encompasses the terms "consisting of" and "consisting essentially of." The use of "consisting essentially of" means, e.g., that a device or method may include additional features, but only if the additional features do not materially alter the basic and novel characteristics of the device or method.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Further, no admission is made that any reference, including any patent or patent document, cited in this specification constitutes prior art. In particular, it will be understood that unless otherwise stated, reference to any document herein does not constitute an admission that any of these documents forms part of the common general knowledge in the art in the United States or in any other country. Any discussion of the references states what their authors assert, and applicant reserves the right to challenge the accuracy and pertinence of any of the documents cited herein.

As used in this specification and the appended claims, the singular forms "a," "an," and "the" include plural referents unless the content clearly dictates otherwise. As used in this specification and the appended claims, the term "or" is generally employed in its sense including "and/or" unless the content clearly dictates otherwise.

Unless otherwise noted, technical terms are used according to conventional usage. However, as used herein, the following definitions may be useful in aiding the skilled practitioner in understanding the invention. Such definitions shall be applied, unless a different definition is given in the claims or elsewhere in this specification.

The term "camouflage" in reference to a pattern or system in accordance with embodiments of the invention is meant to refer to a pattern or system that resembles the coloration and repeated images of traditional camouflage but is not necessarily used to conceal or disguise an individual, vehicle or object in its environment. For example, a camouflage pattern or system in accordance with embodiments of the invention may be used to identify fishermen or fish-loving individuals or objects of such persons. A camouflage material or article of manufacture is meant to refer to fabric or other materials or objects, which may be generally referred to as a "substrate," wherein a pattern in accordance with embodiments of the invention is incorporated therein, applied thereon or otherwise transferred thereto.

As used herein, the term "clothing" is meant to refer to shirts, jackets, coats, uniforms, rain gear, footwear, headgear, vests, outerwear, tank tops, robes, under garments, neckties, suspenders, socks, shoes, boots, skippers, sandals, scarves, jerseys and athletic uniforms, gloves, mittens, stockings, pajamas, night shirts, skirts, belts, caps, hats, baseball caps, visors, head bands and sweatbands, ear muffs, bandanas, bibs, and any other covering designed to be worn on a person's body. In addition, the term "fabric article" refers to clothing and clothing accessories collectively.

As used herein, the term "equipment" is meant to include but not limited to fishing rods, bags, duffle bags, purses, totes, blankets, covers, throws, towels, canes, thermos bottles, tackle boxes, lunch boxes, coolers, flashlights, portable seating, backpacks, duffle bags, weapons, weapon case, umbrellas, glasses, dog clothing/cover, military equipment and any other related or similar item.

As used herein, the term "image" is meant to refer to an optical reproduction or other visual representation of an object or environment produced by an optical device or an electronic device or rendered by drawing by a person or by a computer. "Image" may be a whole image or a portion thereof.

The term "underwater environment" or "underwater habitat" is meant to refer to a setting or scene pertaining to characteristics of underwater regions inhabited by aquatic species such as fish. Such settings or scene are typically dominated by visual features or environmental elements which may include water grasses, water plants, rocks, logs, leaves, sands, corals and branches that occur naturally together. As described in more detail herein, patterns in accordance with embodiments of the invention depict a scene or setting representing an underwater environment or habitat which is a simulated depiction in realistic detail (e.g., photographic detail) of a fish species in its natural underwater habitat. For example, the underwater water environment or habitat for a fresh water fish may be that of a lake with plants, rocks and logs. For a saltwater fish, it may be that of an ocean with coral gardens and sands.

The term "vehicle", as used herein, refers to a boat, a car, truck, motorcycle, lawn tractor, farm tractor, bicycle, tricycle, all terrain vehicle (three- or four-wheeler), golf cart, shopping cart, lawn mower, and tank, as well as a skateboard, roller skate, baby buggy, baby stroller, bull dozer, or any other similar apparatus capable of conveyance that transports people or objects and moving on wheels, runners, tracks, or the like.

In accordance with embodiments of the invention, a pattern or system includes a composite image of a simulated three-dimensional natural underwater environment having fish species therein. The images include a background, foreground and midground. The background and foreground depict environmental elements which may be suitably rocks, water grasses, water plants, branches, logs, leaves, sands, corals and combinations thereof. The midground includes one or more fish native to the environment. The foreground overlays the midground to partially conceal the fish in a manner that simulates the perspective in the natural environment. The colorations in the images are natural colors of the fish, the environment and light reflected in the water.

Reference is now made to FIGS. 1-5 in which a camouflage pattern or system, generally designated by reference numeral 10, in accordance with an embodiment of the invention is shown. FIGS. 1-5 illustrate various exemplary embodiments of the principles embodying camouflage system 10. System 10 may include an article 12 (see, e.g., FIG. 5) and a camouflage pattern 14. Camouflage pattern 14 includes an image 16 of an underwater environment 18. Image 16 includes a background 20 and foreground 22 of natural underwater environmental elements 24 and a midground 26 having fish species 28, including one or more fish 30, which are native to environment 18. The one or more fish 30 overlay background 20. The colorations of background 20 and foreground 22 may include any shade of blue-green, green or yellow, from light green to dark green, to blue green, from yellow to yellow-green. Fish 30 may be of many different sizes, and have a variety of different markings with scales and fins and striations, speckles or splotches. Fish 30 assume any number of different arrangements or positions in relation to environmental elements 24. For example, fish 30 sometimes overlap with or touch the environmental elements 24 tangentially. The fish coloration may include grey, silver, silver-brown, green, brown, blue, blue-green, yellow, yellow-green, black, white and combinations thereof. Pattern 14 is organized and configured to mimic the fish in their natural three-dimensional underwater environment 18 in realistic detail.

Environmental elements 24 suitably include water grasses, rocks, branches, water plants, logs, sands, corals and combinations thereof.

Fish species 28 may be any fish species, whether of the fresh water or salt water variety, and foreground 22, background 20 and midground 26 will all include the underwater environmental elements 24 natural to the particular fish species. Examples of fresh water fish include but are not limited to bass, crappie, musky, carp, trout, salmon, catfish, blue gill and walleye. Examples of salt water fish include but are not limited to swordfish, tuna, grouper, snapper, halibut, cod and flounder.

In various embodiments, image 16 may be a graphically realistic or photographically-realistic image of the natural underwater environment of the fish depicted. In other words, image 16 may be produced so that it looks like an actual image of a natural underwater environment when viewed underwater by an observer.

In embodiments in accordance with the invention, the combination of foreground, background and midground may increase the visual depth of pattern 14, and provide an enhanced three-dimensional visual effect in comparison to conventional camouflage patterns.

Additionally, in at least one embodiment, the use of camouflage system 10 may enhance the ability of camouflage system 10 to obscure an individual or object when viewed from a relatively close distance, a relatively far distance and/or any intermediate distance thereof. As such, system 10 may also enhance the ability of an individual or an object to visually blend-in with a particular environment. In addition, pattern 14 may enhance the aesthetic qualities of an article of clothing or a piece of equipment utilizing camouflage system 10, in comparison to conventional camouflage systems.

FIG. 1 depicts an illustration of an exemplary camouflage pattern or system according to at least one embodiment. As illustrated, camouflage system 10 includes foreground 12 and background 14 with a plurality of water grasses, water plants and logs, and midground 16 having among environmental elements 24 fish species 18 which is bass. Foreground 12, background 14 and midground 16 are illustrative of the natural underwater environment of a bass fish and includes a plurality of bass, partially concealed by foreground 12.

Figure 2:
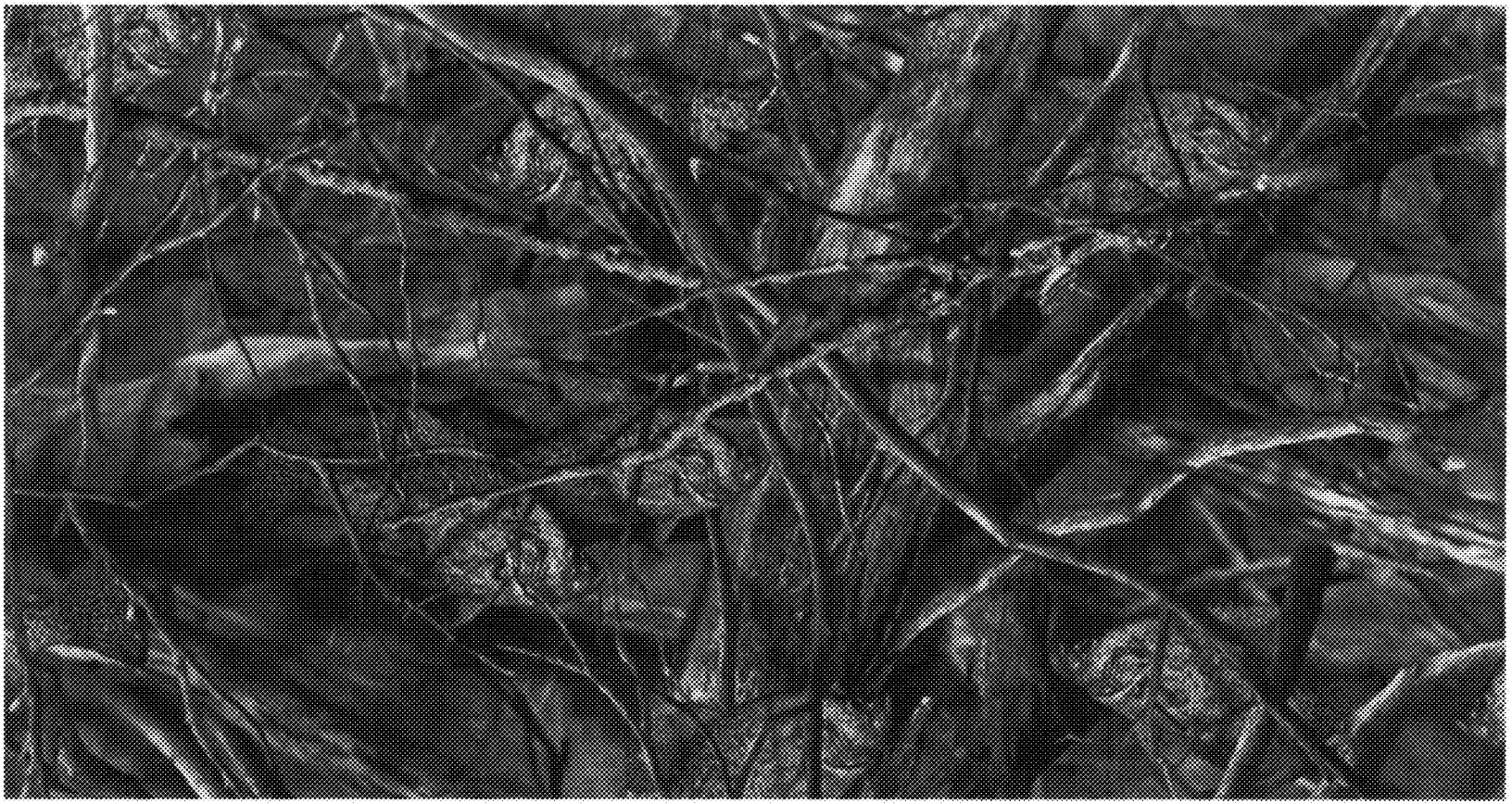
FIG. 2 is a front view of a second exemplary embodiment of a pattern in accordance with the invention.

FIG. 2 depicts another illustration of an exemplary camouflage pattern or system according to at least another embodiment. As illustrated in FIG. 2, fish species 28 suitably includes one or more crappie. As shown, a plurality of crappies is partially concealed by foreground 12.

Figure 3:
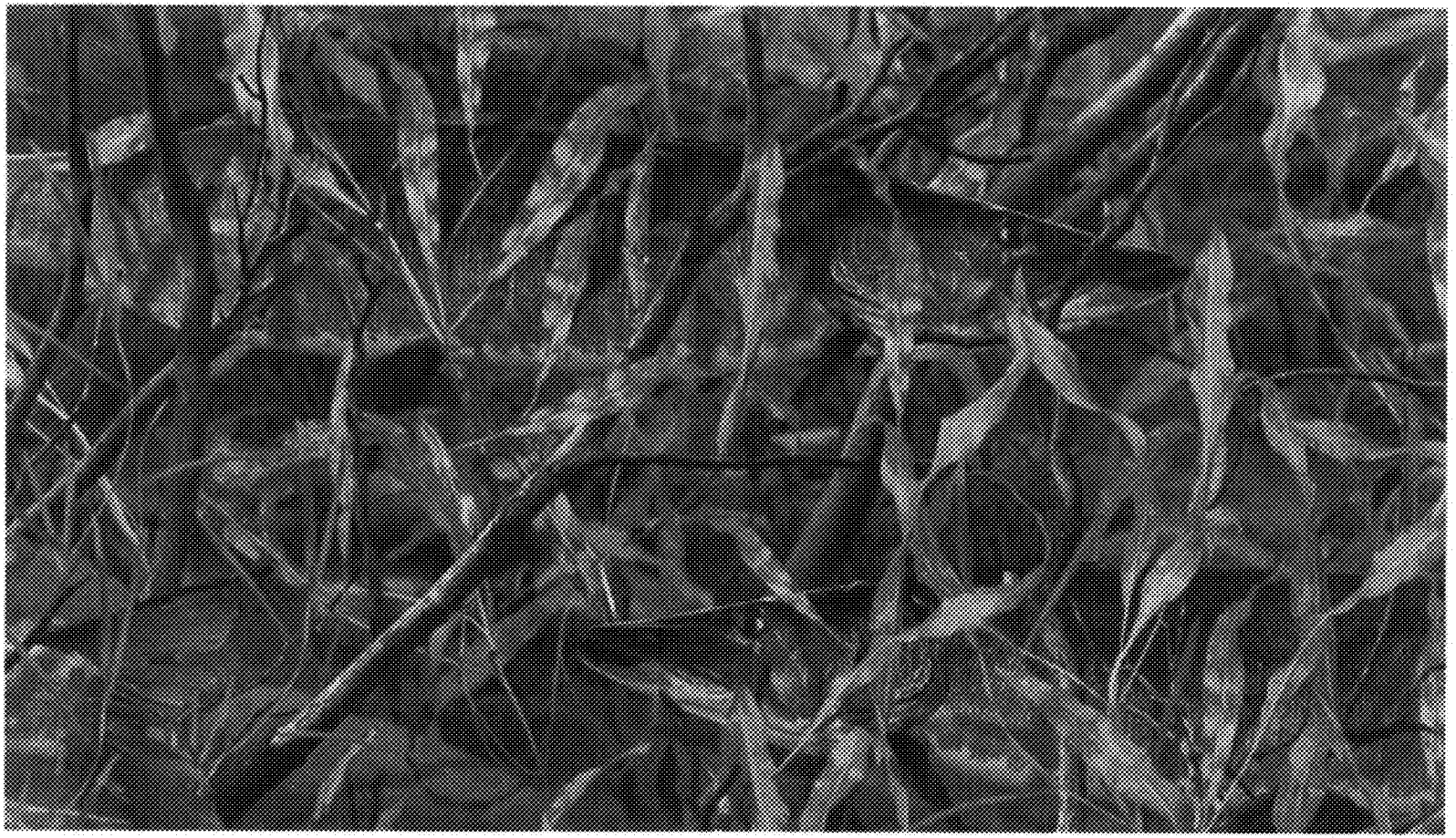
FIG. 3 is a front view of a third exemplary embodiment of a pattern in accordance with the invention.

FIG. 3 depicts another illustration of an exemplary camouflage pattern or system according to at least another embodiment. As illustrated in FIG. 3, fish species 28 suitably includes one or more musky. As shown, a plurality of muskies is partially concealed by foreground 12.

Figure 4:
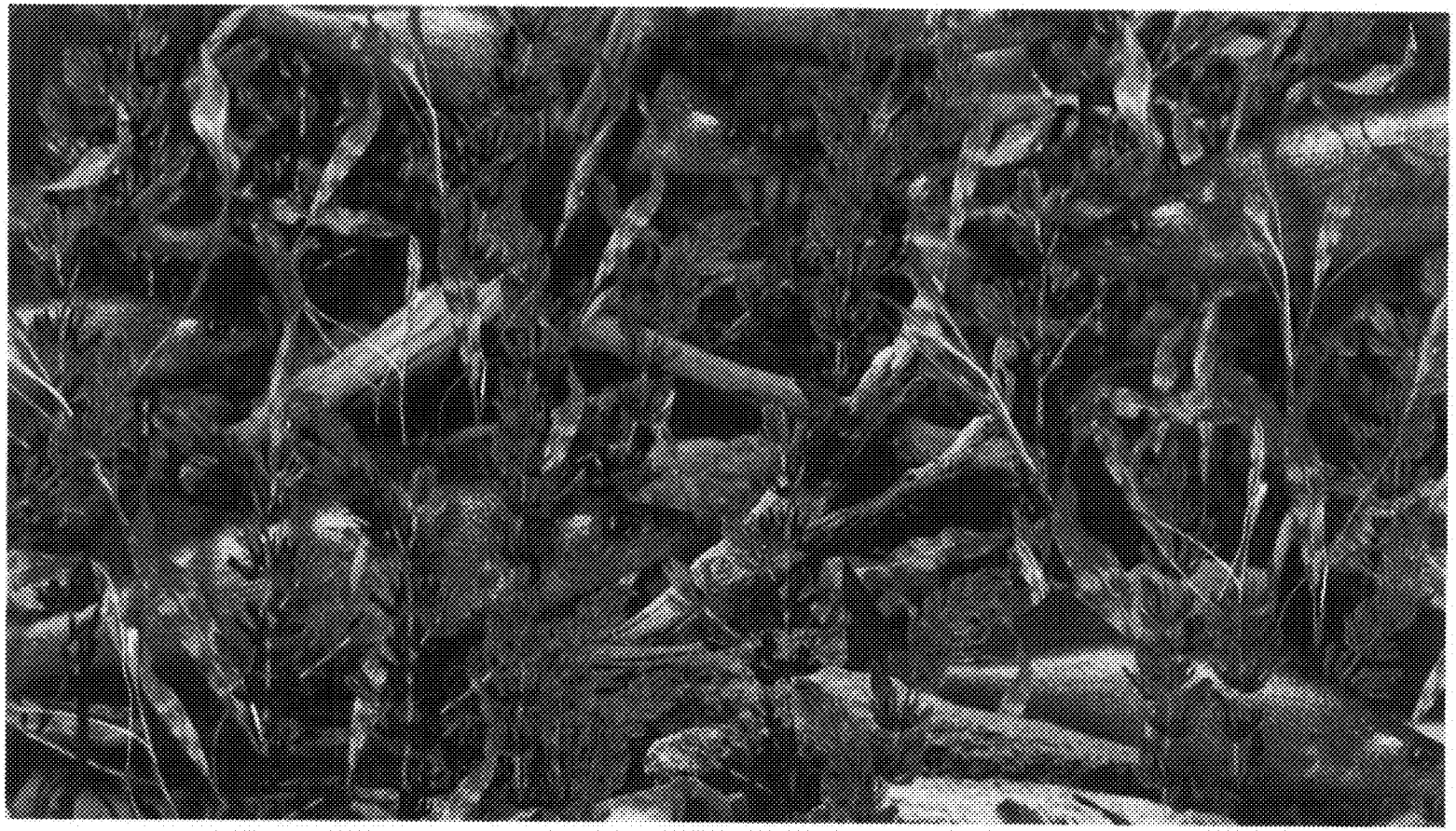
FIG. 4 is a front view of a fourth exemplary embodiment of a pattern in accordance with the invention.

FIG. 4 depicts another illustration of an exemplary camouflage pattern or system according to at least another embodiment. As illustrated in FIG. 4, fish species 28 suitably includes one or more walleye. As shown, a plurality of walleye is partially concealed by foreground 12.

Pattern 14 can be incorporated into or applied to any substrate, e.g., an article of manufacture with appropriate surfaces. Such an article may include an outer surface having pattern 14 of repeating images applied thereon or incorporated therein. As described herein, pattern 14 includes a composite image, in realistic detail, of a simulated three-dimensional natural underwater environment having fish species therein. The images have a background, foreground and midground, the background and foreground depicting environmental elements which may be suitably rocks, water grasses, water plants, branches, logs, leaves, sands, corals and combinations thereof. The midground has one or more fish native to the environment. The foreground overlays the midground to partially conceal the fish. The colorations in the images are natural colors of the fish, the environment and light reflected in the water.

As seen in FIGS. 1-4, pattern 14 is a realistic, photographic-quality scene of a specifically organized underwater environment which corresponds to the actual natural underwater environment of the particular fish species in the pattern.

In one embodiment, the "photograph" is typically composed of many pictures, such as resulting from a camera scanning the image (from left to right, and then from top to bottom) and taking a plurality of parallel and horizontally overlapped rows of pictures with each row having corresponding successions of overlapped pictures in side-by-side relation. Such photographs may be taken specifically with a digital camera to create the camouflage scene or may be accessed from libraries of photographs available online via the internet or on disc.

The process of combining multiple images to produce a panorama or larger image is known. Whatever the actual source, digital pictures are fed into a computer processor and a composite image is formed from a number of overlapped pictures or components thereof. Component images can be selected from whole images and stitched into a larger composite image. Component images are suitably matched for color, contrast and brightness to avoid the stitched parts being easily noticeable due to otherwise easily visible variations between the images. In this regard, computer graphics software is available to accomplish this "smoothing" task. Examples of such programs include Hugin, Panorama Tools, Photostitch, and CleVR.

In an important aspect, the digital photographic image represents the colors, textures and physical objects corresponding to the various underwater features of the actual habitat of the fish species depicted in the composite image as viewed by an underwater observer. That is, the photographs form a large composite three-dimensional pictorial representation of the actual underwater environment, which may be applied to any substrate via any appropriate image transfer method.

Many image transfer methods are known in the art, and vary depending on the substrate to which the image is to be transferred. Such methods include an image-transfer medium upon which the image is formed, and then transferred to the substrate. Known methods include heat transfer methods, e.g., methods that use heat transfer papers, such as dye sublimation, wet transfer plate method, water transfer process, silk screening, ink-jet printing, engraving, etc. Using dye sublimation as an example, a digital image is first produced through the use of computer graphic software as described herein. Then this image is printed onto an image-transfer medium, e.g., a coated media or sheet using a set of special heat-activated inks.

Finally, the image is then transferred to the final product using heat transfer equipment. When heat is applied to the printed coated sheet, the ink sublimates (is absorbed) into the surface of the blind material (i.e., the final product). In other words, during the dye-sublimation process, the dye-sublimation ink is converted into a gas that permeates the fabric and solidifies within the fibers. The dye-sublimation inks can be quick-cure ultraviolet inks, solvent-based inks, and water-soluble, screen-printing inks. Oftentimes, the dye particles that are used in dye sublimation are designed to only bond with polymers, so the higher the polyester content in the material the more dye that will bond giving a brighter image. Other materials may be employed if prepared with a coating or a special layer of polymer for the dyes to bond to. There are fabric enhancers, prep sheets, and sprays that can be added to non-polyester fabrics, which will add a layer of polyester to the material.

As described herein, the transfer process depends, in large part, on the substrate to which the pattern is transferred. In whatever method is appropriate, the pattern in accordance with embodiments of the invention may be formed on an image-transfer medium and then transferred to the substrate. For example, for polyester fabric, engraving rollers may be created with the pattern and then applied to the polyester fabric. For cotton fabric, plates having the pattern thereon are applied to the cotton fabric.

Thus, in another aspect, at least one embodiment includes a method of making a camouflage pattern. Pattern 14 can be composed or constructed of appropriate digital images stored in a programmed computer as described herein. In various embodiments, the method includes selecting, using a programmed computer, one or more digital images stored in the computer, of underwater environmental elements including rocks, water grasses, water plants, branches, logs, leaves, sands, corals and combinations thereof, selecting one or more digital images of fish species native to the selected environmental elements, creating a composite repeatable pattern of a simulated three-dimensional natural underwater environment for the fish species. The pattern has a background, foreground and midground. The background and foreground include underwater environmental elements, and the midground includes one or more fish. The foreground overlays the midground to partially conceal the fish. The colorations in the images are chosen to be the natural colors of the fish, the environment and light reflected in the water. In at least one embodiment, the method includes printing, applying or transferring the pattern onto an article of manufacture.

Figure 5:
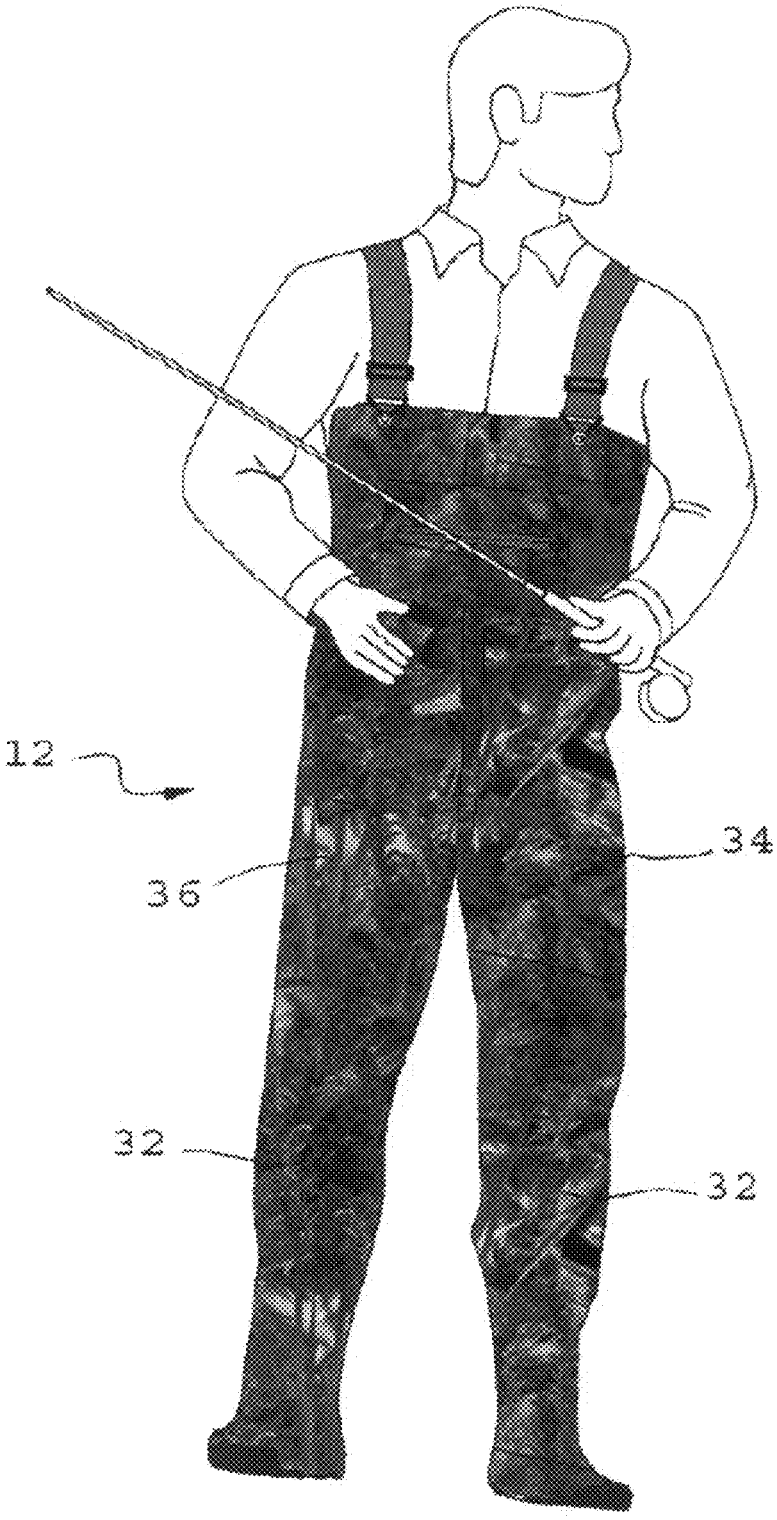
FIG. 5 is a front plan view of an article of manufacture including a pattern of an embodiment in accordance with the invention.

Reference is now made to FIG. 5, which illustrates an exemplary article of manufacture in which pattern 14 is used to construct therefor. FIG. 5 shows a wader 32 which includes camouflage system 10. Wader 32 may be any type of wader, e.g., full bib, waist high, etc. Pattern 14 may be incorporated into the entire wader or may be placed on any portion 34 of wader 32. In one embodiment, pattern 14 may be suitably placed on the exterior surface 36 of wader 32, and may visually conceal wader 32 and the legs of the wearer. For example, it may be possible for the wearer, wearing wader 32 to use wader 32 to approach more closely fish for which the wearer is fishing. In other words, a wearer of wader 32 may be camouflaged or disguised when viewed underwater from a relatively close distance, a relatively far distance, and any intermediate distance.

Although FIG. 5 shows the camouflage pattern in accordance with embodiments of the invention in the form of a wader, the pattern may be used for any item or substrate, including without limitation, for simply a "camo" look, e.g., clothing (e.g., jackets, shirts, pants, footwear, headgear), equipment (e.g., bags, fishing rods, tackle boxes, a throw cover or blanket covering, buckets, bucket covers, thermos bottles, lunch boxes, coolers, flashlights, portable seating, back packs, duffle bags, weapons, weapon cases, vehicle covers, dog clothing/covers, and military equipment, etc.), vehicles (e.g., boats, boat covers, ATMs, automobiles) or a fabric. In some articles, camouflage pattern 14 is suitably applied to a surface of the article, e.g., tackle boxes. In other embodiments, camouflage pattern 14 is used to make the material or fabric from which the article is made, e.g., a shirt made of a fabric which is woven to depict pattern 14. A substrate may also include a vinyl wrapping or other adhesive material for covering physical objects.

The foregoing description is considered as illustrative only of the principles manifest in embodiments of the invention. Numerous modifications and changes may readily occur to those skilled in the art, and it is not desired to limit the invention to the exact construction and operation shown and described, and accordingly, all suitable modifications and equivalents are considered to fall within the scope of the invention. Various features and advantages of the invention are set forth in the appended claims and their equivalents.

All publications, patents and patent applications referenced in this specification are indicative of the level of ordinary skill in the art to which this invention pertains. All publications, patents and patent applications are herein expressly incorporated by reference to the same extent as if each individual publication or patent application was specifically and individually indicated by reference. In case of conflict between the present disclosure and the incorporated patents, publications and references, the present disclosure should control.

The invention claimed is:

1. An article of manufacture having an outer surface, the article comprising an underwater camouflage pattern repeated throughout at least a portion of the surface of the article, the underwater pattern comprising:

one or more of fish a fish species and underwater environmental elements in a photographic composite image of a simulated three-dimensional natural underwater environment of the fish species, the image having colorations which are natural colors of the fish, the environment and light reflected in the water, and having a background, foreground and midground;

the fish partially concealed by the foreground and having colorations matching the colorations of the underwater environmental elements;

the underwater environmental elements being rocks, water grasses, water plants, branches, logs, leaves, sands, corals or combinations thereof.

2. The article of claim 1, wherein the article is clothing, equipment, a vehicle, or fabric.

3. A realistic appearing camouflage pattern, comprising:

a fish species and underwater environmental elements in repeating underwater photographically or graphically realistic images simulating a natural underwater habitat of the fish species, the underwater images having a background, foreground and midground, and having colorations which are natural colors of the fish species, the environmental elements and light reflected the water, the fish species partially concealed by the foreground and having colorations matching the colorations of the environmental elements, the environmental elements being rocks, water grasses, water plants, branches, logs, leaves, sands, corals or combinations thereof, and the midground overlaying the background, and the foreground overlaying the midground.

4. A method of making a realistic appearing camouflage pattern, comprising:

selecting, using a programmed computer, one or more digital images stored in the computer, of underwater environmental elements including rocks, water grasses, water plants, branches, logs, leaves, sands, corals or combinations thereof, selecting one or more digital images of fish species native to the selected underwater environmental elements, and creating a composite repeatable pattern of a simulated three-dimensional natural underwater environment for the fish species, the pattern having a background, foreground and midground, the background and foreground including the underwater environmental elements, and the midground including one or more fish, the midground overlaying the background, and the foreground overlaying the midground partially concealing the fish, wherein the images have colorations which include natural colors of the fish, the environment and light reflected in the water.

5. The method of claim 4, further comprising applying the pattern on an article of manufacture.

6. A realistic appearing camouflage material for use in clothing or other articles, comprising a repeating pattern simulating a natural underwater three-dimensional habitat of a fish species, the pattern comprising one or more fish and natural underwater environmental elements, and having a background, a foreground and a midground, the background and the foreground having the natural underwater environmental elements which are water plants, water grasses, rocks, branches, logs, leaves, sands, corals or combinations thereof, the background and the foreground being any shade of green, blue-green or yellow, from light green to blue-green and from yellow to yellow-green, the midground having the fish overlaying the background and partially concealed by the foreground, and the fish having a variety of different sizes and markings including striations, speckles and splotches, the fish assuming any number of different arrangements or positions in relation to each other and the underwater environmental elements, the fish sometimes overlapping or touching the underwater environmental elements tangentially, and the fish being of one or more varying shades of gray, silver, silver-brown, green, brown, blue-green, yellow-green, blue-silver, white, black, and combinations thereof.

7. The material of claim 6, wherein the water plants are one or more varying shades of green, yellow, and green-yellow or a combination thereof.

8. An underwater camouflage comprising a composite image of underwater elements which are fish and environmental elements simulating the natural underwater habitat of the fish, the composite image being a repeating pattern having a background, foreground and midground, the background and foreground having the underwater environmental elements which are water plants, leaves, branches, logs, leaves, water grasses, sands, corals and combinations thereof, the foreground underwater environmental elements overlaying the midground;

the midground having one or more of the fish, the fish partially concealed by the foreground, and overlapping or touching the background underwater environmental elements, the fish having colorations which are shades of gray, silver, silver-brown, green, brown, blue-green, yellow-green, blue-silver, black, white or combinations thereof.

9. A method of making a realistic appearing camouflage material, comprising:

obtaining a set of digital photographic scenes of natural underwater environmental elements, obtaining a set of digital photographic images of fish, selecting component underwater environmental elements from the digital photographic sets to form a composite image simulating three-dimensional a natural habitat of the fish, selecting images of fish;

placing the selected images of the fish into the composite image, the fish being partially concealed by the underwater environmental elements of the habitat, and applying the composite image to a substrate.

10. The method of claim 9, wherein the selected underwater environmental elements include water grasses, logs, branches, water plants, leaves, sands, rocks, corals and combinations thereof.

11. The method of claim 9, further comprising printing the composite image as a repeating pattern on the substrate.

12. The method of claim 11, wherein the substrate is clothing, a clothing accessory, a vehicle, or outdoor equipment.

13. The method of claim 12, wherein the clothing is a shirt, pants, a uniform, a vest, a tank top, an undergarment, socks, boots, a scarf, pajamas, a skirt, a hat, overalls, or waders.

14. The method of claim 12, wherein the vehicle is a boat, a car, a truck, a motorcycle, a tractor, an all terrain vehicle, a golf cart, a lawn mower, a tank, a rollerboard, a baby buggy, a baby stroller or a bull dozer.

15. A method of making a camouflage material, comprising:

forming an image of a realistic-appearing camouflage pattern on an image transfer medium, the pattern comprising repeating images of a simulated three-dimensional natural underwater environment having fish species therein, the image having a background, foreground and midground, the background and foreground depicting underwater environmental elements which include water plants, leaves, branches, logs, water grasses, sands, corals and combinations thereof, and the midground depicting one or more fish native to the environment, the midground overlaying the background, and the foreground overlaying the midground to partially conceal the fish, wherein the images have colorations which include natural colors of the fish, the environment and light reflected in the water.

16. The article of claim 1, wherein the fish are fresh water fish or salt water fish.

17. The article of claim 16, wherein the fresh water fish are bass, crappie, musky, walleye, salmon, carp, trout, catfish, and blue gill.

18. The article of claim 16, wherein the salt water fish are swordfish, grouper, tuna, snapper, halibut, cod and flounder.

19. An underwater camouflage pattern, comprising:

an underwater composite image configured for camouflaging a fisherman and fishing articles, the underwater image having fish species and underwater environmental elements simulating a natural habitat of the fish species, the environmental elements being rocks, water grasses, water plants, branches, logs, leaves, sands, corals or combinations thereof, the underwater image having a background, foreground and midground and colorations which are the underwater colorations of the fish species, the environmental elements and light reflected from the surface under the water, the background and foreground having the underwater environmental elements, and the midground having one or more fish, the fish partially concealed by the foreground and having colorations matching the colorations of the environmental elements.

* * * * *